US010238579B2

(12) United States Patent
Zonana

(10) Patent No.: US 10,238,579 B2
(45) Date of Patent: Mar. 26, 2019

(54) CUSTOMIZABLE MODULAR CAP SYSTEM FOR USE WITH A PLURALITY OF DIFFERENT SIZED BOTTLES

(71) Applicant: COMPLIANCE MEDS TECHNOLOGIES LLC, North Miami Beach, FL (US)

(72) Inventor: Moses Zonana, Hallandale Beach, FL (US)

(73) Assignee: COMPLIANCE MEDS TECHNOLOGIES LLC, North Miami Beach, FL (US)

( * ) Notice: Subject to any disclaimer, the term of this patent is extended or adjusted under 35 U.S.C. 154(b) by 0 days.

(21) Appl. No.: 15/442,233

(22) Filed: Feb. 24, 2017

(65) Prior Publication Data

US 2018/0243172 A1 Aug. 30, 2018

(51) Int. Cl.

| | |
|---|---|
| ***A61J 7/04*** | (2006.01) |
| ***B65D 41/04*** | (2006.01) |
| ***B65D 45/18*** | (2006.01) |
| ***B65D 51/24*** | (2006.01) |
| ***A61J 1/14*** | (2006.01) |

(52) U.S. Cl.

CPC ..... *A61J 7/0481* (2013.01); *A61J 1/1412* (2013.01); *A61J 7/0418* (2015.05); *B65D 41/0471* (2013.01); *B65D 45/18* (2013.01); *B65D 51/248* (2013.01); *A61J 2200/30* (2013.01)

(58) Field of Classification Search

CPC ..... A61J 7/0076–7/0481; A61J 7/02–7/0418; B65D 45/02–45/18; B65D 51/24–51/248; B65D 41/005–41/0471

USPC ..... 220/254.1–254.9, 256.1; 215/228

See application file for complete search history.

(56) References Cited

U.S. PATENT DOCUMENTS

| | | | | |
|---|---|---|---|---|
| 8,636,166 | B2 * | 1/2014 | Lane | B65D 47/242 215/228 |
| 2003/0168456 | A1 * | 9/2003 | Tomasella | B65D 41/0421 220/257.1 |
| 2008/0149368 | A1 | 6/2008 | Van Hees et al. | |
| 2008/0149638 | A1 * | 6/2008 | Van Hees | B65D 47/263 220/254.8 |
| 2009/0101644 | A1 * | 4/2009 | Maiwald | B65D 47/0838 220/254.1 |
| 2010/0084397 | A1 * | 4/2010 | Kubo | B65D 47/18 220/256.1 |
| 2014/0001182 | A1 * | 1/2014 | Wood | B65D 41/04 220/254.1 |

(Continued)

*Primary Examiner* — Kareen K Thomas

(74) *Attorney, Agent, or Firm* — Leason Ellis LLP

(57) ABSTRACT

A cap is configured to be securely attached to a bottle, such as a medication bottle, and includes a base having a first compartment that contains a power source and a second compartment that is below the first compartment. The second compartment is defined by a peripheral side wall that includes on an inner surface thereof one or more locking tabs. The cap also includes an insert that is configured to be received within the second compartment. The insert includes a peripheral side wall and further including inner threads that are configured to threadingly mate with outer threads of the bottle for securely attaching the cap to the bottle. The insert includes a locking lip that snap-fittingly mate with the one or more locking tabs to detachably attach the insert to the base within the second compartment.

22 Claims, 10 Drawing Sheets

(56) References Cited

U.S. PATENT DOCUMENTS

| | | | | |
|---|---|---|---|---|
| 2014/0291279 | A1* | 10/2014 | Robertos | A61J 1/03<br>215/365 |
| 2014/0332494 | A1* | 11/2014 | Balakier | A61J 7/04<br>215/365 |
| 2015/0129592 | A1* | 5/2015 | Staples | B65D 41/0407<br>220/254.7 |

* cited by examiner

CUSTOMIZABLE MODULAR CAP SYSTEM FOR USE WITH A PLURALITY OF DIFFERENT SIZED BOTTLES

TECHNICAL FIELD

The present invention relates to compliance management and in particular, to a dispensing cap that can be part of a customizable modular cap system and controls dispensing of articles based on compliance to a prescribed dispensing schedule and also keeps a record of the dispensing history and is configured to receive a selected insert (adapter) to permit the dispensing cap to mate with a selected bottle having prescribed characteristics (dimensions).

BACKGROUND

There are many different situations in which the contents in a receptacle, such as a bottle, are dispensed according to a schedule and it is desirable to maintain a log to see if the dispensing schedule was adhered to. One such setting is the dispensing of medication from a bottle.

The majority of medicines and drugs require administration in a series of doses at specific times over a period of time for increased effectiveness. Outside of a hospital or clinic setting, this usually requires the patient or an individual caring for the patient to be responsible for keeping track of the medication in question. However, a frequent problem is that the patient or the individual caring for the patient errs in the administration of the medicine. Patients may forget to take a dose of their medication, be tardy in taking a dose, or forget entirely to take a dose and/or take a second dose too soon, etc.

In addition, with some drugs, such as controlled substances (e.g., oxycodone), there is a risk that patient may not follow the dosage instructions as a result of a drug addiction and/or there is even a risk that a patient may illegally sell and distribute some of the pills and then subsequently allege that the pills are misplaced, lost, or stolen, etc.

A number of approaches to solving the above problems have been proposed and embodied in different devices. In particular, there are a number of devices that include a pill case or box with a timer or alarm to alert the patient that a certain time period has passed and that the medication should be taken. Also, these simple alarms provide no means to ensure or check compliance with administration of the medication. Moreover, if the patient fails to take the medication at the prescribed time, the patient is likely to fail to reset the timer or alarm.

In addition, existing products are not particularly suited to handle different sized and different shaped pills but instead, typically require a new entire dispensing device for different categories of pills. This is costly and also overly complex.

In addition, the traditional dispensing devices are configured to work only with a bottle of a single type. As will be readily appreciated, medicine bottles comes in many different sizes based in part on the size of pills themselves and/or the quantity of the pills that are contained in the bottle. Thus, when the dispensing device is incorporated into the cap, the device can only mate with a single bottle and if additional prescriptions are obtained that have different bottle sizes, the user would be unable to use the dispensing device with those other bottles. There is therefore a need for a medication dispensing device that is configured to mate with different sized bottles.

SUMMARY

In accordance with the present invention, a dispensing cap, such as a medication dispensing cap, that is part of a modular cap system and is configured to be securely attached to a bottle includes a base having a first compartment that contains a power source and a second compartment that is below the first compartment. The second compartment is defined by a peripheral side wall that includes on an inner surface thereof one or more locking tabs. The dispensing cap also includes an insert that is configured to be received within the second compartment. The insert includes a peripheral side wall and further including inner threads that are configured to threadingly mate with outer threads of the bottle for securely attaching the dispensing cap to the bottle. The insert includes a locking lip that snap-fittingly mates with the one or more locking tabs to detachably attach the insert to the base within the second compartment.

BRIEF DESCRIPTION OF THE DRAWING FIGURES

DETAILED DESCRIPTION OF CERTAIN EMBODIMENTS

Figure 1:
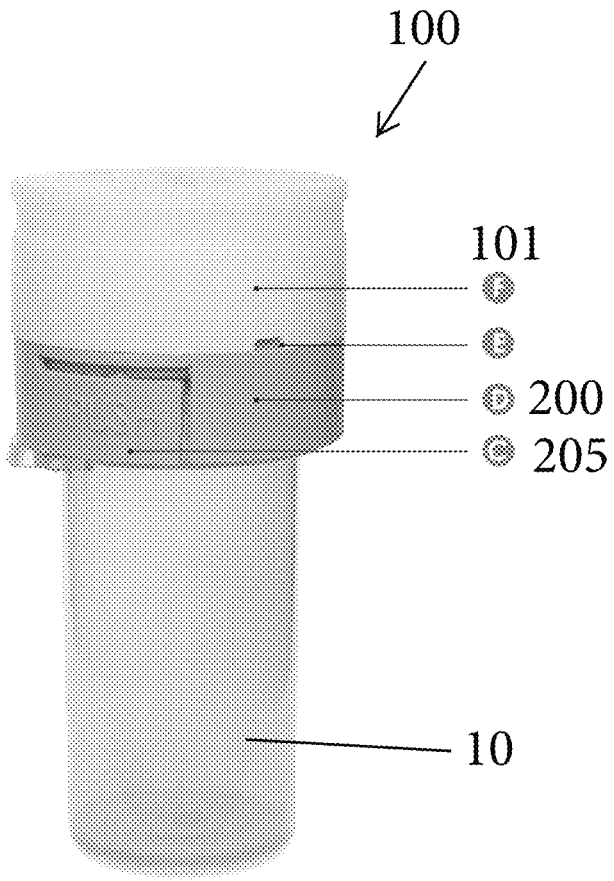
FIG. 1 is a side view of a dispensing cap of the present invention installed on a bottle.
Figure 2:
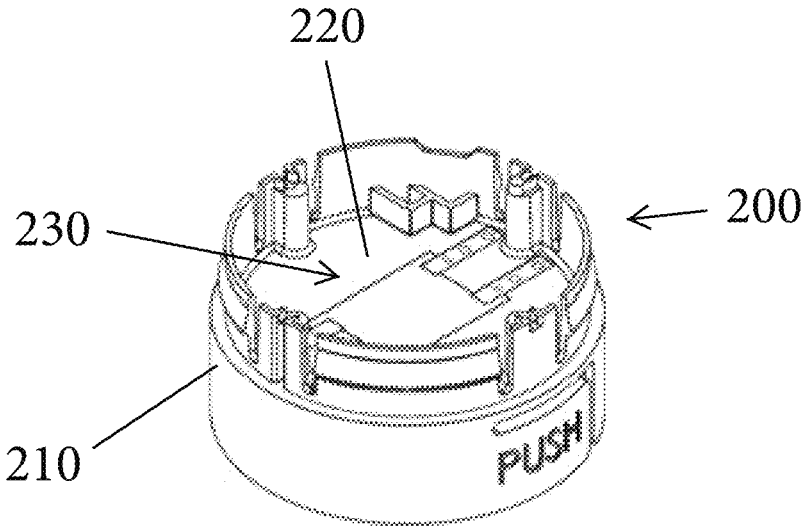
FIG. 2 is top and side perspective view of a base of a dispensing cap according to one embodiment.

As shown in FIG. 1, the present invention relates to a dispensing cap 100 that replaces a traditional bottle cap and monitors how often a bottle 10 is accessed to withdraw the contents (pills, etc.) thereof. The cap 100 is referred to as a dispensing cap since the contents of the bottle cannot be accessed and dispensed until the cap 100 is removed from the bottle 10. Traditional bottles 10 includes an open end that contains outer threads that mate with inner threads of the medication dispensing cap 100. The medication dispensing cap 100 includes a cover 101 that covers and protects a power source (e.g., one or more batteries) that powers the electronics of the dispensing cap 100. The cover 101 also lights up to provide visual alerts. A small opening (e.g., horizontal slot) that is formed in the cover 101 allows a user to remove the cover 101 from the base 100 to expose the power source.

Figure 6:
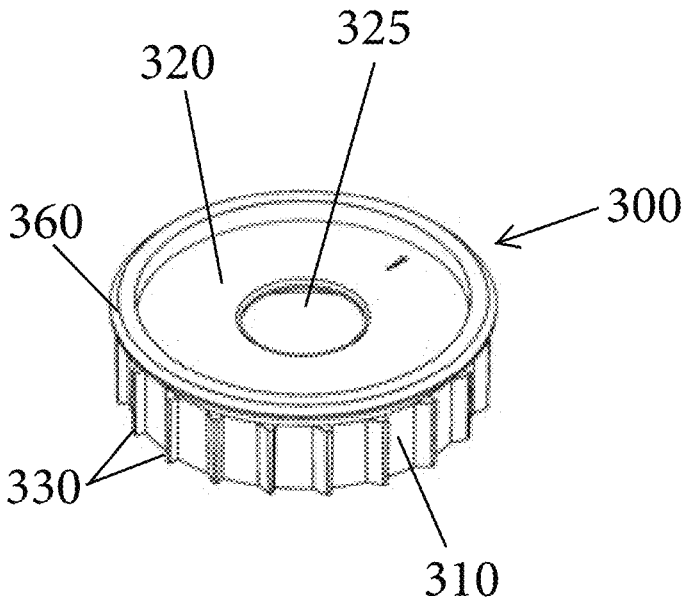
FIG. 6 is a top and side perspective view of a first insert (adapter) for insertion and secure coupling to the base.
Figure 7:
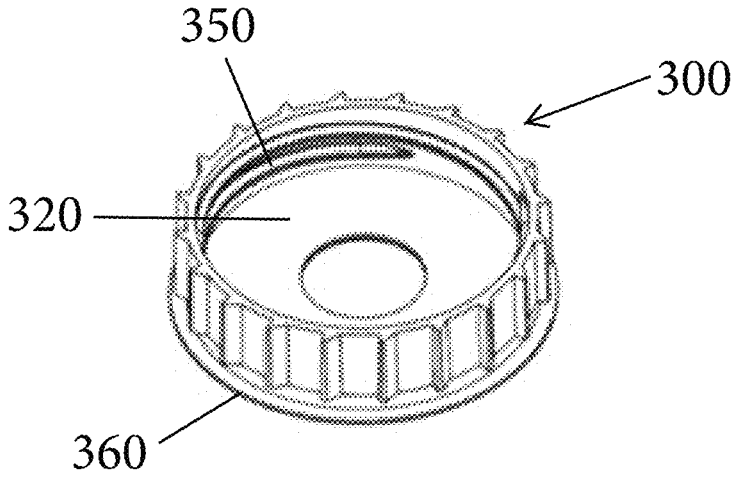
FIG. 7 is a bottom and side perspective view of the first insert.
Figure 8:
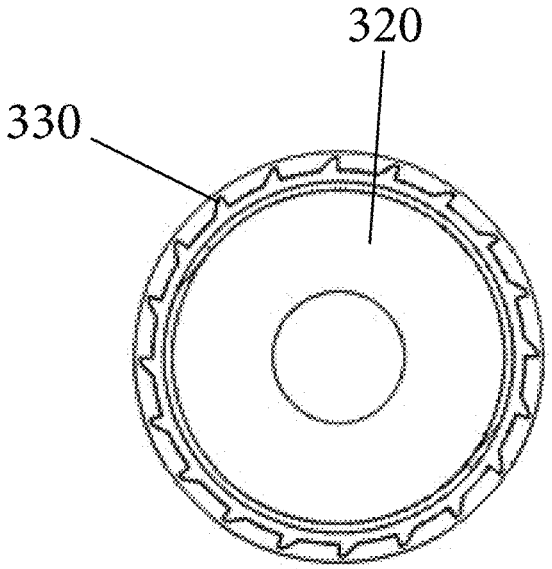
FIG. 8 is a bottom plan view thereof.
Figure 9:
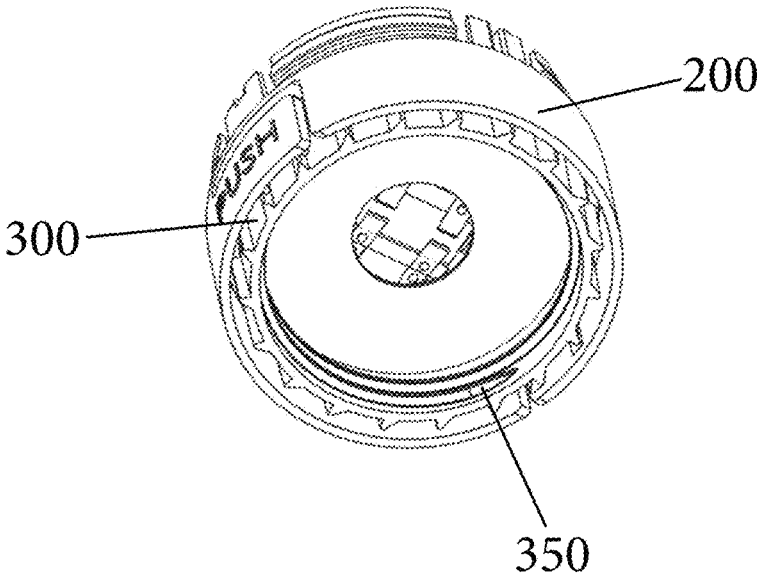
FIG. 9 is a bottom perspective view of the first insert coupled to the base to form an assembled dispensing cap.

The dispensing cap 100 is formed of two main parts, namely, a base 200 and an insert 300 (FIG. 6). The base 200 is shown in FIGS. 2-5. The base 200 is defined by a body that includes a peripheral side wall 210 and an inner transverse wall 220 that extends between the side wall 210. The inner transverse wall 220 partitions the base 200 into a first (upper) compartment 230 and a second (lower) compartment 240. The first compartment 230 is designed to house the power house (one or more batteries) as well as other electronics, such as a printed circuit board, etc.). As described in more detail herein, the second compartment 240 receives the insert 300 (FIG. 6).

The base 200 also can include one or more safety tabs 205 (push tabs) that are configured to release and remove the medication dispensing cap 100 from the bottle 10 and allow access to the contents within.

As will be described in more detail herein, within the second compartment 240, the base 200 includes one or more locking tabs 250 (e.g., a male or female locking member). Preferably, the base 200 includes a plurality of locking tabs 250 that are formed circumferentially about the peripheral side wall 210 in spaced relationship. Each of the locking tabs 250 comprises a tab or protrusion (rail) that extends inwardly into the second compartment 240. The locking tab 250 can be thought of as defining a ledge. The inner surface of the peripheral side wall 210 includes one or more and preferably a plurality of ribs 255. The ribs 255 are oriented vertically.

FIGS. 6-8 and 17 illustrate the first insert 300 which is configured to be detachably attached to the base 200 within the second compartment 240 and is selected and constructed in view of the specifications of the bottle 10. The first insert 300 includes a peripheral side wall 310 and an inner (transverse or end) wall 320 that extends between the peripheral side wall 310. The inner wall 320 includes a center opening 325.

An outer surface of the peripheral side wall 310 includes a plurality of ribs 330 that extend circumferentially about the peripheral side wall 310. The ribs 330 are oriented vertically. An inner surface of the peripheral side wall 310 includes inner threads 350 that are configured to interlocking and threadingly mate with the outer threads of the bottle 10. The first insert 300 also includes a locking lip 360 (e.g., male or female locking member) that is defined along the top edge of the first insert 300. The locking lip 360 protrudes outwardly from the peripheral side wall 310 and represents a circumferential flange. As shown, the locking lip 360 includes a chamfered (beveled) edge 362 that can act as a cam surface. A space 370 is formed between the locking lip 360 and the ribs 330.

Figure 3:
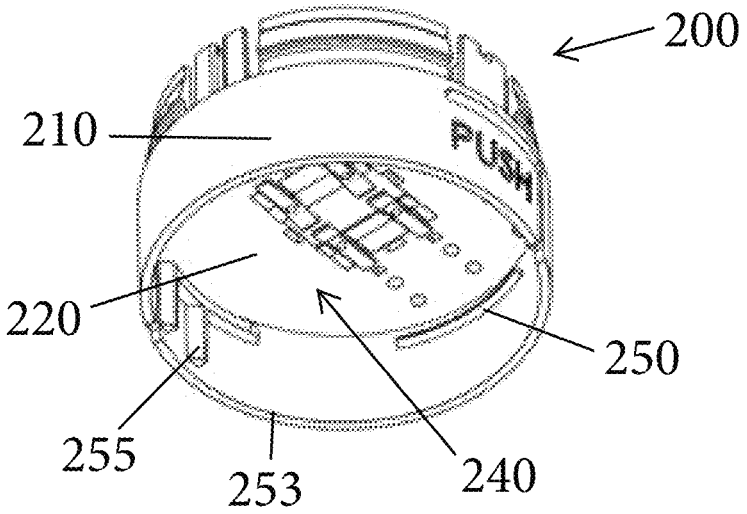
FIG. 3 is a bottom and side perspective view of the base.
Figure 4:
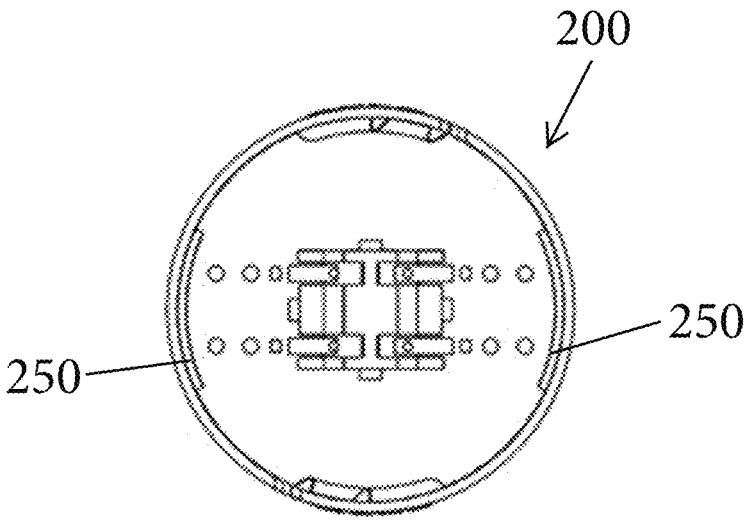
FIG. 4 is a bottom plan view thereof.
Figure 5:
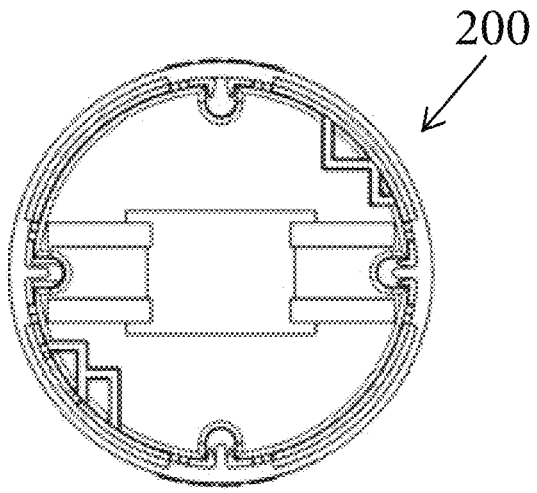
FIG. 5 is a top plan view thereof.
Figure 10:
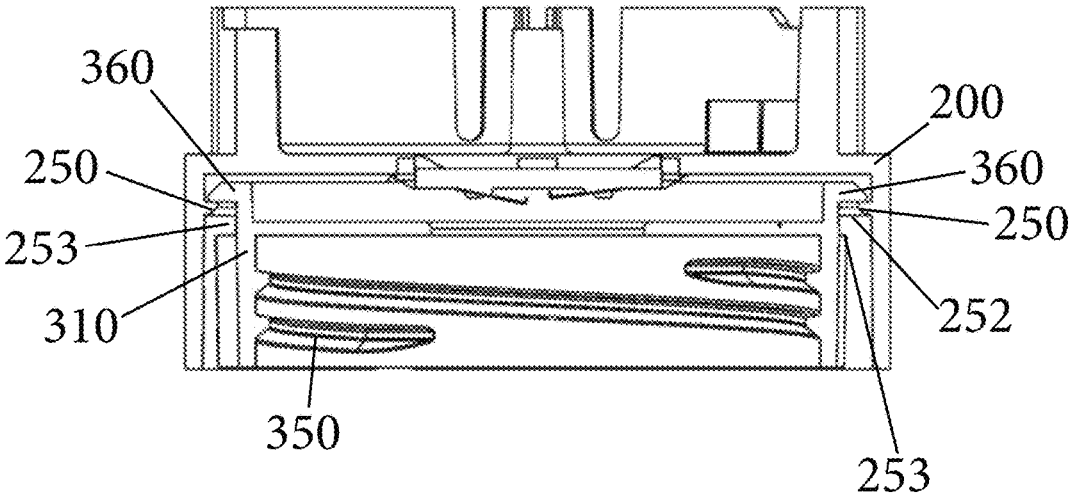
FIG. 10 is a cross-sectional view of the assembled dispensing cap.
Figure 11:
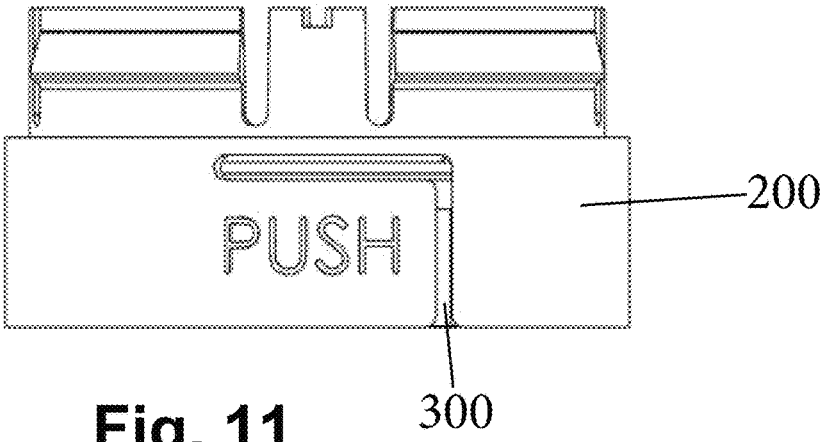
FIG. 11 is a side elevation view of the assembled dispensing cap.

FIGS. 9-11 and 17-19 illustrate the first insert 300 detachably secured to the base 200 by being inserted into the second compartment 240. The locking tab 250 includes a chamfered (beveled) edge 252 that can act as a cam surface. As shown in FIGS. 3 and 10, the inner surface of the peripheral side wall 210 also can includes an inner rail (protrusion) 253 that is formed circumferentially about the peripheral side wall 210 and is spaced from the locking tab 250.

As shown, when the first insert 300 is inserted into the second compartment 240 of the base 200, the chamfered edge 362 of the locking lip 360 contacts the chamfered edge 252 of the locking tab 250 and the parts 200, 300 are permitted to have some flexibility such that continued insertion of the first insert 300 into the base 200 results in the locking lip 360 clearing the locking tab 250 resulting in attachment between the first insert 300 and the base 200. In other words, a snap fit is formed between the two parts 200, 300. Tactile and/or auditory feedback is received by the user during this coupling motion. The inner rail 253 seats against the peripheral side wall 310. In addition, the vertical ribs 255 can locate and restrict rotation of the insert within the base 200. The vertical ribs 255 engage the ribs 330.

It will be understood that other locking arrangements between the insert 300 and base 200 can be used, such as a male/female locking arrangement, etc. For example, in a male/female arrangement, the male part (e.g., protrusion) which is associated with one of the insert 300 and base 200 slides into engagement with a female part (e.g., opening).

To detach the first insert 300 from the base 200, the user can insert a tool into the space between the peripheral side walls 210, 310 and is manipulated to cause the disengagement between the locking lip 360 from the locking tab 250, thereby freeing the insert 300 for removal from the base 200.

Figure 12:
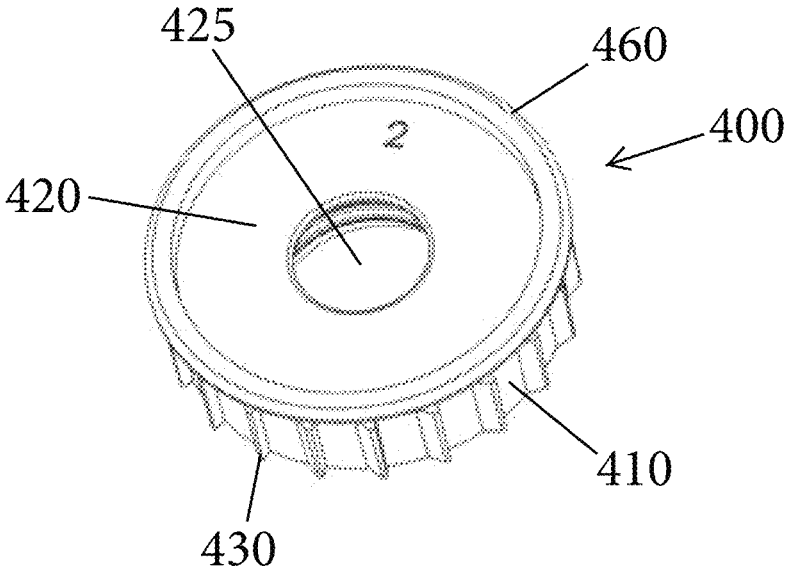
FIG. 12 is a top perspective view of a second insert (adapter) for insertion and secure coupling to the base.
Figure 13:
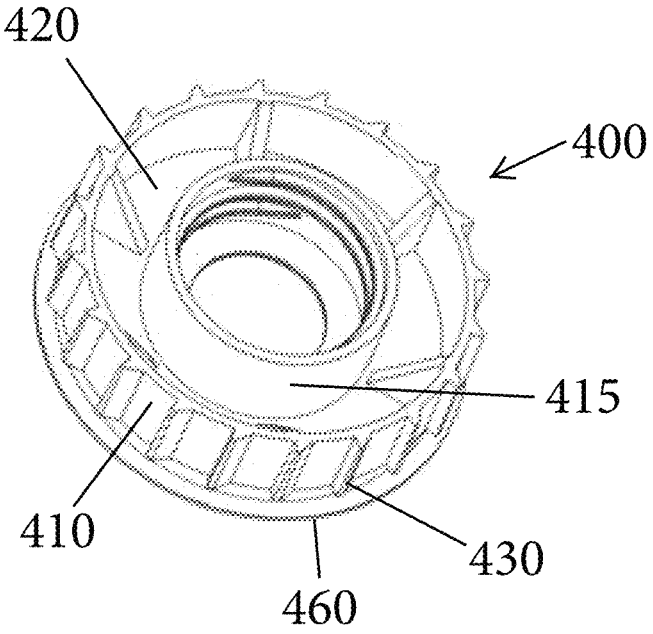
FIG. 13 is a bottom perspective view thereof.
Figure 14:
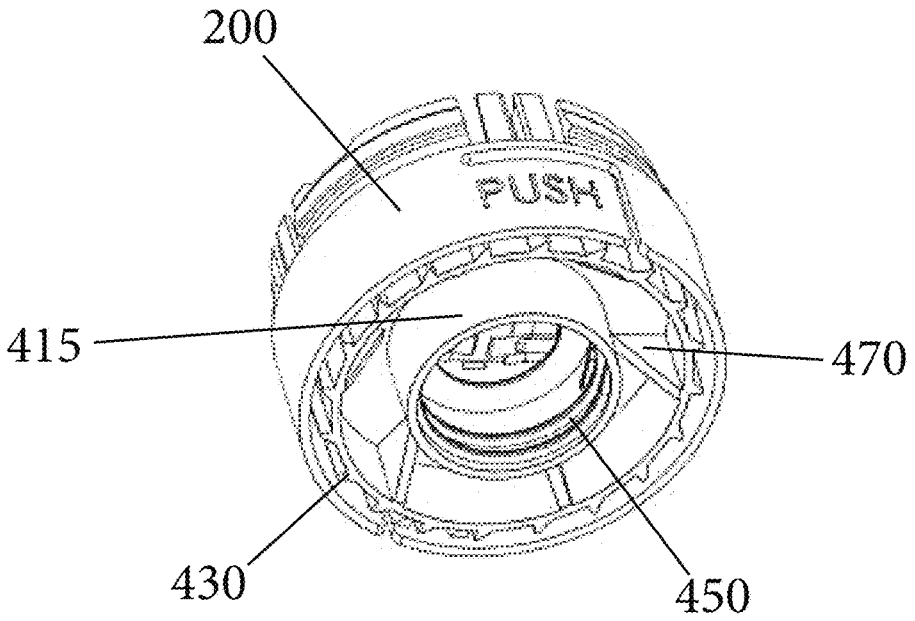
FIG. 14 is a bottom perspective view of the second insert coupled to the base to form an assembled dispensing cap.
Figure 15:
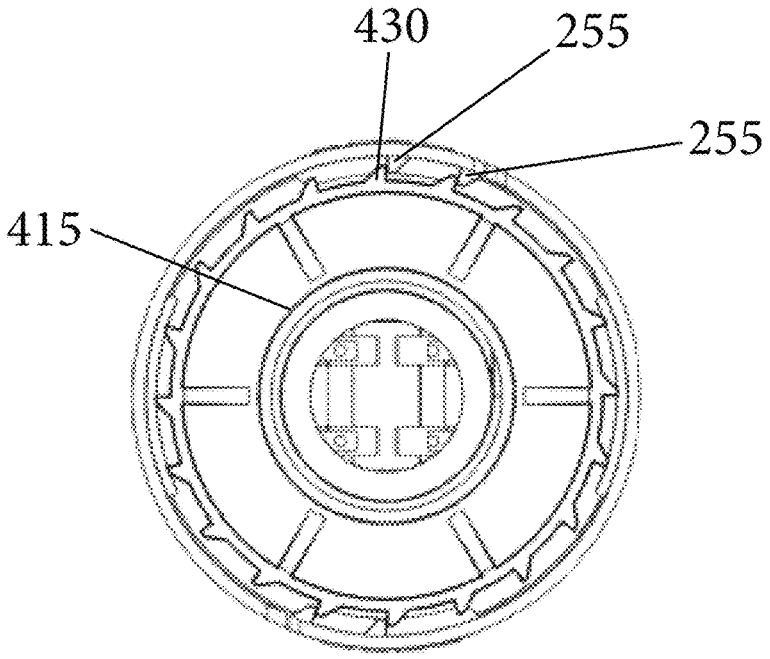
FIG. 15 is a bottom plan view thereof.

FIGS. 12 and 13 illustrate a second insert 400 which is configured to be detachably attached to the base 200 within the second compartment 240 and is selected and constructed in view of the specifications of the bottle 10. The second insert 400 includes a peripheral side wall 410 and an inner (transverse) wall 420 that extends between the peripheral side wall 410. The inner wall 420 includes a center opening 425.

An outer surface of the peripheral side wall 410 includes a plurality of ribs 430 that extend circumferentially about the peripheral side wall 410. The ribs 430 are oriented vertically. An inner surface of the peripheral side wall 410 includes an inner circumferentially wall 415 that is disposed about the center opening 425. The inner circumferentially wall 415 includes inner threads 450 that are configured to interlocking and threadingly mate with the outer threads of the bottle 10. The first insert 400 also includes a locking lip 460 that is defined along the top edge of the second insert 400. The locking lip 460 protrudes outwardly from the peripheral side wall 410 and represents a circumferential flange. As shown, the locking lip 460 includes a chamfered (beveled) edge 462 that can act as a cam surface. A space 370 is formed between the locking lip 460 and the ribs 430.

Structural support is built into the second insert 400 by including support ribs 470 that are formed between the inner surface of the peripheral side wall 410 and the inner circumferential wall 415. The support ribs 470 can be in the shape of triangular shaped ribs that are integral to the inner wall 420.

Figure 16:
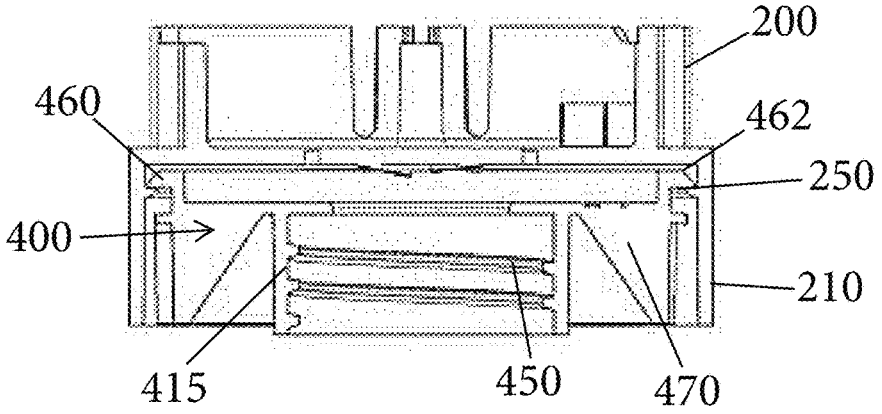
FIG. 16 is a cross-sectional view thereof.
Figure 17:
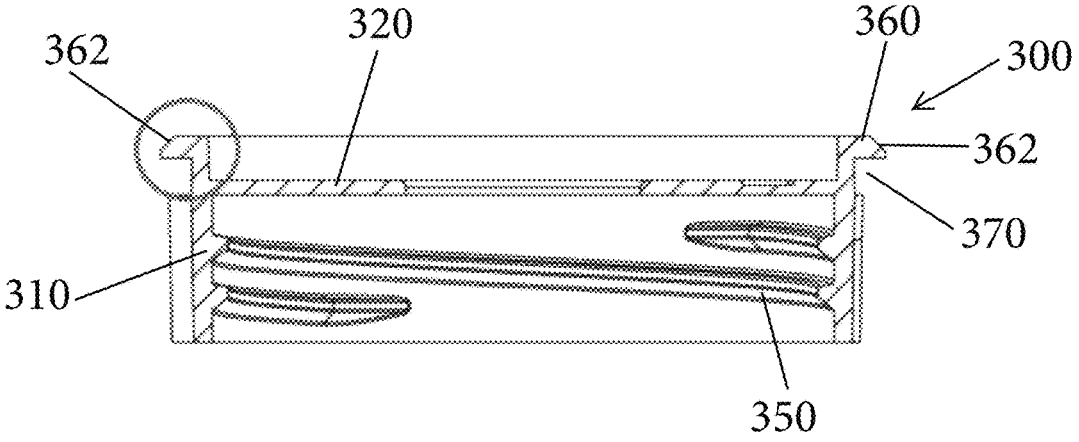
FIG. 17 is a cross-sectional view of an insert showing a locking lip thereof.
Figure 19:
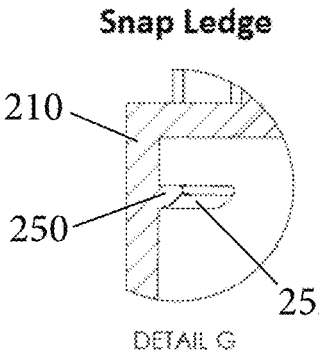
FIG. 19 is a close-up of the coupling feature of the base.
Figure 18:
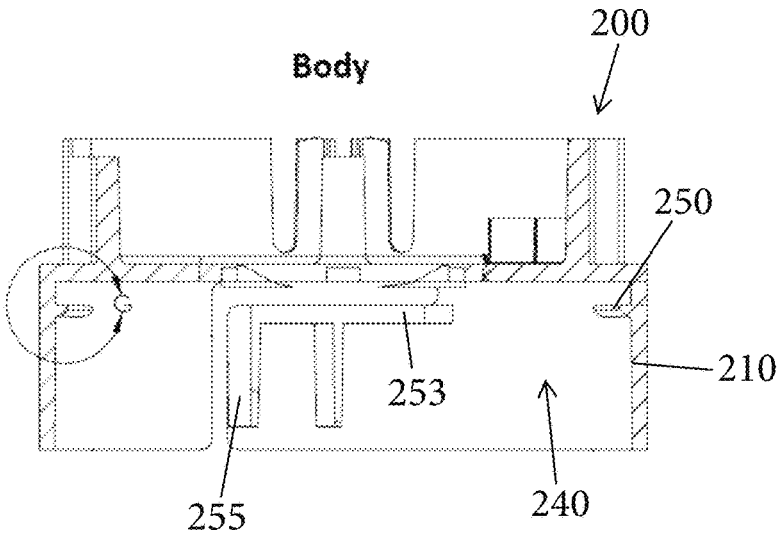
FIG. 18 is a cross-sectional view of the base showing a coupling (locking) feature thereof.

FIG. 16 illustrates the mating between the second insert 400 and the base 200 in which, as described, the locking lip 460 snap-fittingly engages the locking tab 250.

It will be understood that the construction of the medication dispensing cap 100 of the present invention permits the cap 100 to fit any number of different sized bottles by offering a single base 200 and a number of inserts (adapters) 300 that can be chosen in view of the bottle size. Unlike traditional dispensing caps in which the entire cap is constructed to mate to a single bottle only, the present invention employs a modular construction in which the common base 200 is constructed to be used with one insert (adapter) 300 chosen from amongst a set of inserts 300 that are each configured to mate with one bottle 10.

In accordance with the present invention, the caps described herein can, in one embodiment, be configured to detect when the cap is removed from the bottle and to record (i.e., date stamp) the temporal details of such event. The cap thus includes a means for detecting (detection means) when the cap is detached and removed from the bottle. For example, a mechanical switch can be provided within the cap such that when the bottle is mated to the cap, the switch is closed and when the cap is removed from the bottle, the switch opens and a signal is generated to indicate such event. Instead of a mechanical switch, any number of other suitable sensors and related technologies can be implemented. For example, the sensor can be an optical sensor, an inductive sensor, a capacitive sensor, etc. that is configured to detect when the cap is removed from the bottle. The detection means (e.g., a switch) can be disposed in any number of different locations within the second compartment of the base and in particular, can be located along the upper region of the peripheral side wall or can be located along the underside of the inner wall that extends between the peripheral side wall of the base. When the detection means is in the form of a mechanical switch, the switch is located where it does not interfere with the threading between the bottle and the cap but is positioned such that when the bottle is tightly secured to the base, the mechanical switch is compressed so as to close a circuit or the like and a signal is generated. In one embodiment, the base includes a PCB that has pogo pin style connectors that connect to one or more contacts in the body of the base. In the center hole of the insert there is an actuator that moves up or down based on the closing or opening of the bottle. When the bottle is closed, the actuator is maintained in an up position resulting in contact with the contacts on the base body and the pogo pins that connect to the PCB. In this fashion, a mechanical switch is formed and the closing of the bottle (by screwing the cap thereto) results in closing of the switch which is registered and recorded by the PCB.

The power source is thus connected to a processor which is operatively connected to the means for detecting the removal of the cap from the bottle and thus, when the cap is removed, a signal is received by the processor to record such event in memory, etc. Also the cap can include transmission means (e.g., Bluetooth connection or cellular transmitter, etc.) that allows the events recorded by the cap to be transmitted over a network to another site, such as a computing device, server, etc. The transmitter can be contained in the first compartment. As also mentioned, a light source, such as an LED, is also disposed within the first compartment underneath the cover and connected to the power source and processor to allow timed illumination of the cover to indicate certain events, such as a dispensing time.

It will also be appreciated that while the specification describes the cap as being part of a medication bottle system, the present invention is not limited in scope to such single application since this is merely one exemplary application. Thus, the caps discloses herein can be attached to any number of different sized receptacles, such as bottles or containers. The contents of the receptacles can be a wide number of different articles and medication is merely one exemplary embodiment; however, the contents can be virtually any type of content that can be contained in a receptacle. The contents can be a liquid or solid and take any number of different forms.

Moreover, while the dispensing cap can include a means for detecting when the cap is removed from the bottle, the cap constructions and modular cap system disclosed herein can be incorporated into traditional cap designs that do not include such monitoring/detection system.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A medication dispensing cap that is configured to be securely attached to a bottle containing medication comprising:

a base having one compartment formed therein, the one compartment being defined by a peripheral side wall that includes on an inner surface thereof one or more locking tabs;

an insert that is configured to be received within the one compartment, the insert including a peripheral side wall and further including inner threads that are configured to threadingly mate with outer threads of the bottle for securely attaching the medication dispensing cap to the bottle, the insert including a locking lip that snap-fittingly mates with the one or more locking tabs to detachably attach the insert to the base within the one compartment and wherein rotation of the insert within the base is restricted;

wherein the base has another compartment formed therein that contains a power source and electronics that are configured to detect when the medication dispensing cap is attached to the bottle and when the medication dispensing cap is detached from the bottle.

2. The medication dispensing cap of claim 1, wherein the inner surface of the peripheral side wall of the base includes one or more vertical rails that are configured to mate with a plurality of vertical ribs formed along an outer surface of the peripheral side wall of the insert.

3. The medication dispensing cap of claim 1, wherein the locking lip is formed at an upper end of the insert and extends radially outward from the peripheral side wall of the insert.

4. The medication dispensing cap of claim 3, wherein the locking lip includes a chamfered edge and each locking tab includes a chambered edge that is oriented such that when the insert is inserted into the one compartment of the base, the chamfered edges of the locking lip and locking tabs contact one another and allow the locking lip to clear each locking tab to snap-fittingly attach the insert to the base.

5. The medication dispensing cap of claim 1, wherein the one or more locking tabs comprises a plurality of locking tabs that are circumferentially formed along the inner surface of the peripheral side wall of the base and are spaced apart from one another.

6. The medication dispensing cap of claim 1, wherein the inner threads are formed along an inner surface of the peripheral side wall on the insert.

7. The medication dispensing cap of claim 1, wherein the insert further includes an inner circumferential wall that is spaced inwardly from the peripheral side wall of the insert, the inner threads being formed on an inner surface of the inner circumferential wall such that a top portion of the bottle is disposed between the inner circumferential wall.

8. The medication dispensing cap of claim 1, wherein the insert includes an end wall that extends between the peripheral side wall of the insert, the end wall having a central opening formed therein.

9. The medication dispensing cap of claim 8, wherein the end wall is recessed relative to a top edge of the insert at which the locking lip is formed.

10. The medication dispensing cap of claim 1, wherein the base includes a first set of spaced apart ribs located along an inner surface thereof and the insert includes a second set of spaced part ribs located along an outer surface thereof, the first and second sets of ribs mating together to restrict the rotation of the insert within the base.

11. The medication dispensing cap of claim 1, wherein the base completely surrounds the insert.

12. The medication dispensing cap of claim 1, wherein the base defines both a top edge of the medication dispensing cap and a bottom edge of the medication dispensing cap.

13. A customizable modular cap system that is configured to be securely attached to a plurality of different sized bottles, the customizable modular cap system comprising:

a single base having one compartment that is at least partially defined by a peripheral side wall that includes on an inner surface thereof at least one first locking member; and a plurality of inserts that are configured to threadingly mate with the plurality of different sized bottles such that each insert is configured to be securely and threadingly attached to one respective bottle of the plurality of different sized bottles, each insert including a second locking member that mates with the first locking member to detachably attach the insert to the single base, within the one compartment thereof, to form one customized cap, each insert including a peripheral side wall for reception between the peripheral side wall of the single base, the peripheral side wall of the insert including inner threads that are configured to threadingly mate with outer threads of the one respective bottle for securely attaching the one customized cap to the one respective bottle.

14. The customizable modular cap system of claim 13, wherein the customized cap is configured to detect and record each instance in which the customized cap is detached from the one respective bottle.

15. The customizable modular cap system of claim 14, wherein the single base has another compartment that contains a power source is located above the one compartment, the single base further including a processor connected to the power source and configured to detect and record when the customized cap is detached from the one respective bottle.

16. The customizable modular cap system of claim 13, wherein the plurality of different sized bottles comprises different sized medication bottles that each contains a medication.

17. The customizable modular cap system of claim 13, wherein the first locking member comprises a locking tab and the second locking member comprises a locking lip that snap-fittingly mates to the locking tab.

18. The customizable modular cap system of claim 13, wherein the insert further includes an inner circumferential wall that is spaced inwardly from the peripheral side wall, the inner threads being formed on an inner surface of the inner circumferential wall such that a top portion of the bottle is disposed between the inner circumferential wall, wherein the inner threads are formed along an inner surface of the inner circumferential wall.

19. The customizable modular cap system of claim 13, wherein there is an annular shaped space formed between the peripheral side wall of the insert and the peripheral side wall of the base for receiving a tool to detach the insert from the base.

20. A cap that is configured to be securely attached to a bottle that has outer threads at an open end thereof, the cap comprising:

a base having one compartment that is defined by a peripheral side wall that includes on an inner surface thereof a first locking member; and a customized insert that is configured to be received within the one compartment, the insert including inner threads that are configured to threadingly mate with the outer threads of the bottle for securely attaching the cap to the bottle, the insert including a second locking member that mates with the first locking member to detachably attach the insert to the base within the one compartment;

wherein the base is closed off with a cover that permits light transmission and the cover is disposed over an electronics compartment formed in the base, the electronics compartment containing a power source, a light source, and a processor.

21. The cap of claim 20, wherein the first and second locking members mate in a snap-fitting fashion and the insert is at least substantially contained within the one compartment.

22. A medication dispensing cap that is configured to be securely attached to a bottle containing medication comprising:

a base having one compartment formed therein, the one compartment being defined by a peripheral side wall that includes on an inner surface thereof one or more locking tabs;

an insert that is configured to be received within the one compartment, the insert including a peripheral side wall and further including inner threads that are configured to threadingly mate with outer threads of the bottle for securely attaching the medication dispensing cap to the bottle, the insert including a locking lip that snap-fittingly mates with the one or more locking tabs to detachably attach the insert to the base within the one compartment and wherein rotation of the insert within the base is restricted;

wherein the insert further includes an inner circumferential wall that is spaced inwardly from the peripheral side wall of the insert, the inner threads being formed on an inner surface of the inner circumferential wall such that a top portion of the bottle is disposed between the inner circumferential wall.

* * * * *